US006856084B2

(12) United States Patent
Nihei et al.

(10) Patent No.: US 6,856,084 B2
(45) Date of Patent: Feb. 15, 2005

(54) FLUORESCENT DISPLAY DEVICE

(75) Inventors: Mitsuyoshi Nihei, Mobara (JP); Yuji Nomura, Mobara (JP); Yusuke Yasuoka, Mobara (JP); Toshinori Suzuki, Mobara (JP); Junichiro Kogure, Mobara (JP); Tadashi Mizohata, Mobara (JP)

(73) Assignee: Futaba Corporation, Mobara (JP)

( * ) Notice: Subject to any disclaimer, the term of this patent is extended or adjusted under 35 U.S.C. 154(b) by 0 days.

(21) Appl. No.: 09/895,322

(22) Filed: Jul. 2, 2001

(65) Prior Publication Data

US 2002/0005693 A1 Jan. 17, 2002

(30) Foreign Application Priority Data

Jul. 12, 2000 (JP) ..... 2000-210661

(51) Int. Cl.[7] ..... H01J 1/62; H01J 63/04
(52) U.S. Cl. ..... 313/495
(58) Field of Search ..... 313/461, 466, 313/470, 473, 110–117, 495–497, 514, 517, 478; 359/839, 893

(56) References Cited

U.S. PATENT DOCUMENTS

| | | | | | |
|---|---|---|---|---|---|
| 4,100,455 | A | * | 7/1978 | DuBois | 313/495 |
| 4,803,399 | A | * | 2/1989 | Ogawa et al. | 313/493 |
| 5,177,396 | A | * | 1/1993 | Gielen et al. | 313/113 |
| 5,698,642 | A | * | 12/1997 | Govoni et al. | 526/65 |
| 5,936,342 | A | * | 8/1999 | Ono et al. | 313/310 |
| 6,441,544 | B1 | * | 8/2002 | Ando et al. | 313/310 |

* cited by examiner

*Primary Examiner*—Ashok Patel
*Assistant Examiner*—Sumati Krishnan
(74) *Attorney, Agent, or Firm*—Oblon, Spivak, McClelland, Maier & Nuestadt, P.C.

(57) ABSTRACT

A fluorescent display device having a pseudo half mirror formed on a rear surface a face plate thereof and exhibiting a function like a neutral density filter. The face plate is formed on a whole rear surface thereof with an aluminum film including opening portions, non-opening portions and a solid portion. The opening and non-opening portions cooperate with each other to constitute a pseudo half mirror. The pseudo half mirror has light transmittance determined depending on a ratio in area between the opening portions and the non-opening portions. Thus, the light transmittance may be set as desired by varying the area ratio.

7 Claims, 4 Drawing Sheets

FLUORESCENT DISPLAY DEVICE

BACKGROUND OF THE INVENTION

This invention relates to a fluorescent display device, and more particularly to a fluorescent display device wherein a face plate is formed thereon with a pseudo half mirror.

Now, a conventional fluorescent display device including a half mirror will be described with reference to FIGS. 4(*a*) and 4(*b*). The conventional fluorescent display device includes an anode-side substrate 11 made of glass. The anode-side substrate 11 is formed thereon with anode electrodes 12 each having a phosphor deposited thereon. Also, the conventional fluorescent display device includes grids 13 arranged above the anode electrodes 12 in a manner to be spaced from each other at predetermined intervals and from the anode-side substrates 11 at predetermined intervals. Further, the fluorescent display device includes filamentary cathodes 14 arranged above the grids 13 in a manner to be spaced from each other at predetermined intervals and from the grids and therefore the anode-side substrate 11 at predetermined intervals. Reference numeral 21 designates a face plate made of glass. The face plate 21 is formed on a rear surface thereof with a chromium film 22. The fluorescent display device also includes side plates 31 and 32 made of glass. The anode-side substrate 11, face plate 21 and side plates 31 and 32 thus arranged are sealedly joined to each other by means of sealing glass materials 33 and 34, to thereby constitute a vacuum envelope.

The chromium film 22 acts as a half mirror, which functions to improve contrast of display as in a neutral density filter. Also, the half mirror exhibits both an electrostatic shielding function and an electron diffusion function. Such functions are disclosed in Japanese Utility Model Application Laid-Open Publication No. 108646/1980.

The chromium film 22 shown in FIGS. 4(*a*) and 4(*b*) is constructed so as to permit light transmittance thereof to be varied depending on a thickness thereof. For example, the thickness of 100 Å permits the chromium film 22 to exhibit light transmittance of about 10% and that of 190 Å permits it to exhibit transmittance of 0%. Thus, the thickness of 190 Å keeps the chromium film 22 from transmitting light therethrough. Therefore, formation of the chromium film 22 into a half mirror requires to reduce a thickness of the chromium film 22 to a level of 190 Å or less. Light transmittance of the chromium film 22, as described above, is varied depending on a thickness thereof. Thus, substitution of the chromium film 22 for the neutral density filter requires to form the chromium film 22 into a thickness which permits it to exhibit light transmittance at a predetermined level. However, light transmittance of the chromium film 22 is substantially varied depending on a slight variation in thickness thereof, thus, the thickness must be accurately controlled at a level as small as Å. This causes formation of the chromium film 22 to be highly troublesome. Also, manufacturing of the fluorescent display device requires a calcination step of heating it to a temperature as high as 400° C. or more. However, this causes oxidation of the chromium film 22 during the calcination, to thereby reduce light transmittance thereof.

Thus, the prior art not only renders control of the film thickness and formation of the film troublesome or hard, but causes a reduction in light transmittance of the film due to oxidation thereof during the calcination, resulting in manufacturing of the chromium film which has desired light transmittance being hard.

The chromium film 22 fails to exhibit conductivity when a thickness thereof is reduced to a level of 40 Å or less. When the chromium film 22 has a thickness which permits it to function as a half mirror, it is increased in resistance, so that it fails to satisfactorily exhibit an electrostatic shielding function and an electron diffusion function. Also, the chromium film 22 is formed into a very small thickness. This, when a contact lead is pressedly contacted with the chromium film 22, causes a portion of the chromium film 22 contacted with the lead to be damaged, so that electrical connection therebetween may be often deteriorated. Chromium for the chromium film 22 is harmful, resulting in handling of chromium and a treatment thereof during manufacturing of a fluorescent display device being troublesome, leading to a failure to facilitate manufacturing of the fluorescent display device and an increase in manufacturing cost thereof. Further, chromium is expensive to a degree sufficient to significantly increase a manufacturing cost of the device. Also, disposal of the fluorescent display device after a life thereof ends is in danger of causing environmental pollution by chromium.

In the conventional fluorescent display device, the chromium film 22, as shown in FIG. 4(*b*), is formed on only a portion of the rear surface of the face plate 21 arranged in the vacuum envelope, to thereby be kept from being formed on an area between the sealing glass material 33 and the face plate 21. Thus, when the face plate 21 is viewed from an outside of the fluorescent display device, an adhesion area formed by the sealing glass material 33 is observed as an architrave-like frame around a display section of the fluorescent display device, so that the display section is observed in a size smaller than an actual size thereof. Also, the chromium film 22 is caused to exhibit a blue to green color due to a high temperature at which it is exposed during calcination of the fluorescent display device. Such discoloration is disadvantageously amplified when an equipment such as an acoustic equipment, an image display equipment or the like on which the fluorescent display device is mounted has metallic finish or exhibits a metallic feeling, leading to a deterioration in a harmony of colors or design between the equipment and the fluorescent display device.

SUMMARY OF THE INVENTION

The present invention has been made in view of the foregoing disadvantage of the prior art.

Accordingly, it is an object of the present invention to provide a pseudo half mirror which is capable of keeping light transmittance thereof from depending on a thickness thereof.

It is another object of the present invention to provide a pseudo half mirror which is capable of being manufactured with ease.

It is a further object of the present invention to provide a pseudo half mirror which is capable of being manufactured at a low cost.

It is still another object of the present invention to provide a pseudo half mirror which is capable of exhibiting satisfactory heat dissipating characteristics, an improved electrostatic shielding function and an improved electron diffusion function while being harmless.

It is yet another object of the present invention to provide a fluorescent display device which is capable of exhibiting a satisfactory harmony of colors or designs with respect to an equipment of metallic finish on which the fluorescent display device is mounted.

In accordance with the present invention, a fluorescent display device is provided. The fluorescent display device includes a vacuum envelope constituted by a face plate, an anode-side substrate and side plates, cathodes arranged between the face plate and the anode-side substrate, and a metal film for a pseudo half mirror arranged on a rear surface of the face plate and including opening portions and non-opening portions.

In a preferred embodiment of the present invention, the metal film is formed on a whole rear surface of the face plate.

In a preferred embodiment of the present invention, the metal film is made of aluminum.

In a preferred embodiment of the present invention, the opening portions and non-opening portions are arranged in a lattice-like manner.

In a preferred embodiment of the present invention, the metal film is formed with a void portion for conforming deposition of a getter thereon.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 1(*b*) is a sectional view taken along line Y—Y of FIG. 1(*a*);

FIG. 2(*b*) is a plan view showing a modification of FIG. 2(*a*);

FIG. 3(*b*) is a sectional view of the fluorescent display device shown in FIG. 3(*a*);

FIG. 4(*b*) is a fragmentary enlarged sectional view of the conventional fluorescent display device shown in FIG. 4(*a*).

DETAILED DESCRIPTION OF THE PREFERRED EMBODIMENTS

Now, a fluorescent display device according to the present invention will be described with reference to FIGS. 1(*a*) to 3(*b*).

Figure 1A:
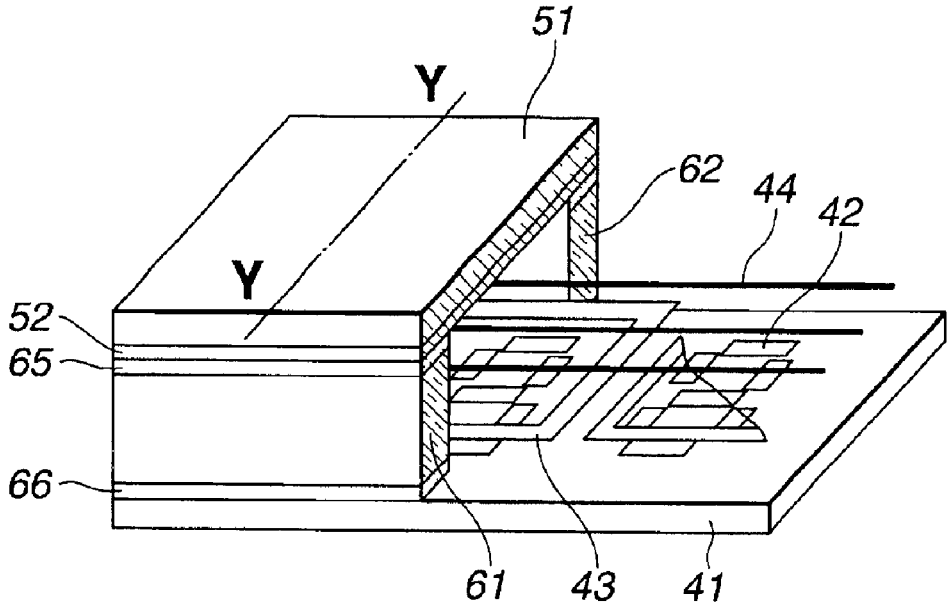
FIG. 1(*a*) is a perspective view showing an embodiment of a fluorescent display device according to the present invention.
Figure 1B:
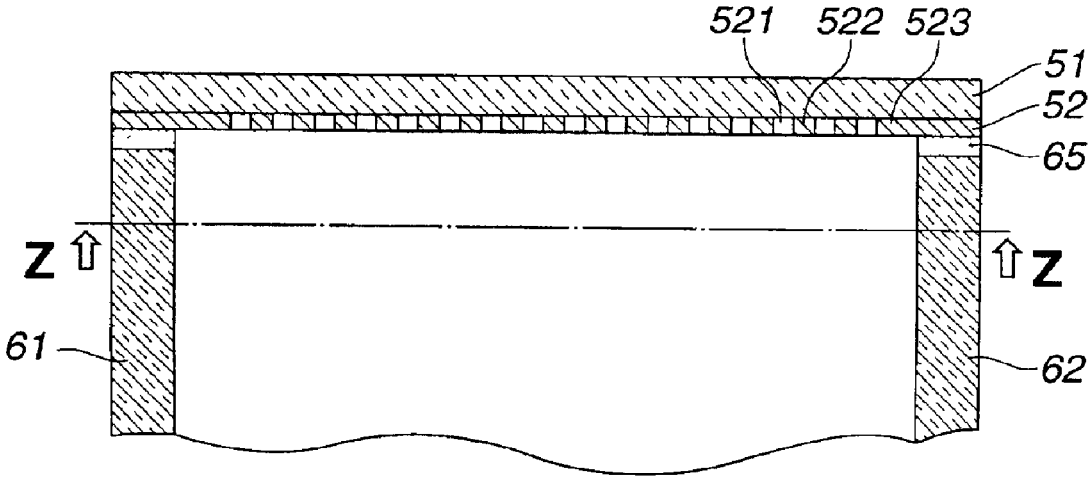

Referring first to FIGS. 1(*a*) to 2(*a*), an embodiment of a fluorescent display device according to the present invention is illustrated. A fluorescent display device of the illustrated embodiment includes an anode-side substrate 41 made of glass. The anode-side substrate 41 is formed thereon with phosphor-deposited anode electrodes 42. The fluorescent display device also includes grids 43 and filamentary cathodes 44 arranged above the anode electrodes 42 at predetermined intervals. Reference numeral 51 designates a face plate made of glass. The face plate 51 has an aluminum film 52 formed all over a whole rear surface thereof facing the anode-side substrate 41. Reference numerals 61 to 64 designate side plates made of glass each acting as a side member. The anode substrate 41, face plate 51 and side plates 61 to 64 are sealedly jointed to each other by means of sealing glass materials 65 and 66, to thereby constitute a vacuum envelope.

The aluminum film 52 is formed at a portion thereof corresponding to a display section with opening portions 521 and non-opening portions 522 in a lattice-like manner. Also, the aluminum film 52 is formed at a peripheral portion thereof with a solid portion 523 so as to surround the opening portions 521 and non-opening portions 522. The opening portions 521 are constructed so as to permit light to permeate therethrough and the non-opening portions 522 and solid portion 423 are constructed so as to keep light from permeating therethrough. This permits an interior of the fluorescent display device to be observed through the opening portions 521 but prevents the interior from being observed through the non-opening portions 522 and solid portion 523. A degree at which the interior of the fluorescent display device is distinctly observed is determined depending on a ratio in area between the opening portions 521 and the non-opening portions 522.

The present invention is constructed so as to improve contrast of display by substituting the aluminum film 52 for the conventional neutral density filter while taking notice of the fact that a degree at which the interior of the fluorescent display device is observed is varied depending on a ratio in area between the opening portions 521 and the non-opening portions 522. More particularly, the aluminum film 52 is falsely varied in light transmittance depending on a ratio in area between the opening portions 521 and the non-opening portions 522, to thereby exhibit a function like the conventional half mirror which is varied in light transmittance depending on a thickness thereof.

The term "pseudo half mirror" used herein means an element which is made of the aluminum film 52 and exhibits a function like a half mirror.

Such a pseudo half mirror made of the aluminum film 52 has light transmittance adjusted as desired by varying a ratio in area between the opening portions 521 and the non-opening portions 522, thus, the light transmittance may be selected in view of a type of the fluorescent display device, reflectance of an inner surface of the fluorescent display device, reflectance of each of parts arranged therein so that contrast at a desired level may be obtained. For example, when a display section constituted by a phosphor increased in brightness or luminance such as, for example, ZnO:Zn or the like and that constituted by a phosphor reduced in luminance such as, for example, (Zn,Cd)S:Ag,Cl or the like are arranged together in the same fluorescent display device, it may be carried out to reduce light transmittance of a portion of the pseudo half mirror corresponding to the display section increased in luminance or increase light transmittance of a portion of the pseudo half mirror corresponding to the display section decreased in luminance. Alternatively, both may be combined with each other. This permits the pseudo half mirror to be partially varied in light transmittance to balance the luminance. Also, when reflectance at the interior of the fluorescent display device is partially varied, the pseudo half mirror may be partially varied in light transmittance in correspondence to a variation in reflectance.

When the pseudo half mirror made of the aluminum film 52 is not arranged, the parts or members provided in the fluorescent display device are caused to be seen through the envelope during turning-off of the fluorescent display device, so that the fluorescent display device may be unsightly. Also, this causes light to be reflected by the members arranged in the envelope during turning-on of the fluorescent display device, so that display obtained may be deteriorated in contrast. Further, an excessive reduction in light transmittance of the pseudo half mirror causes the phosphor being excited for luminescence to be hard to observe. A level at which light transmittance of the pseudo half mirror is to be set is so selected that contrast at desired level may be provided in view of reflectance at the interior of the fluorescent display device, luminance of the phosphor and the like. For example, in the illustrated embodiment, the non-opening portions 522 each may be formed into a width of 30 μm and the opening portions 521 each may be formed into a width of 30 μm. Such configuration permits the light transmittance to be set at a level of 20 to 25%.

The aluminum film 52 is formed into a thickness sufficient to permit the non-opening portions 522 and solid portion 523 to lose light-permeable characteristics thereof. For example, in the illustrated embodiment, it may be formed into a thickness of 1000 Å or more.

Figure 4A:
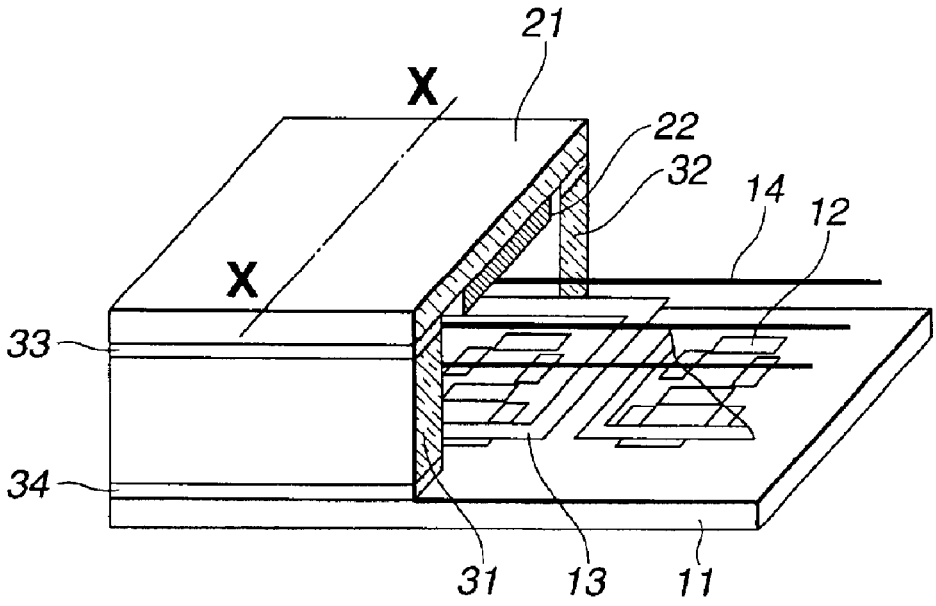
FIG.4(a) (PRIOR ART)
FIG. 4(*a*) is a perspective view showing a conventional fluorescent display device.
Figure 4B:
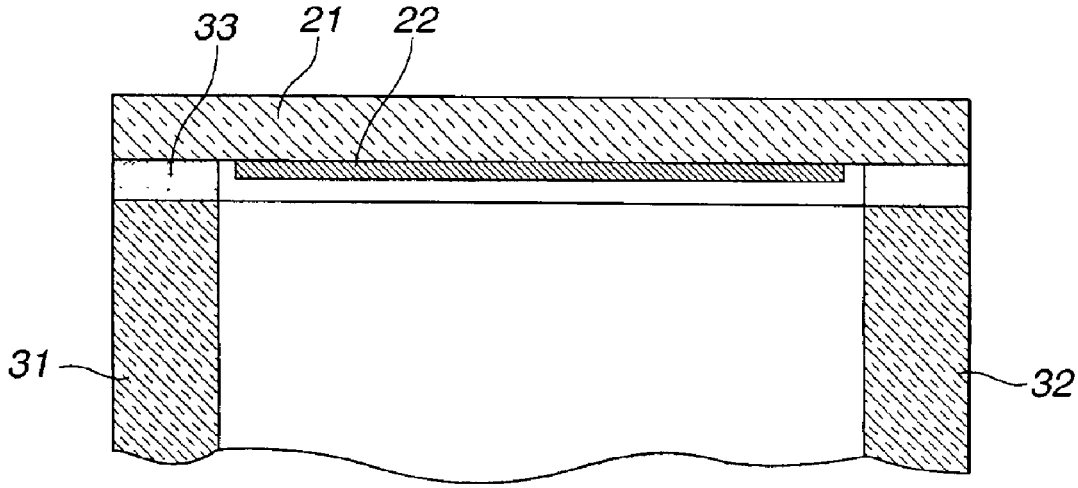
FIG.4(b) (PRIOR ART)

The aluminum film 52 constituting the pseudo half mirror is inherently conductive, to thereby exhibit an electrostatic shielding function and an electron diffusion function as well, like the conventional half mirror made of the chromium film 22 shown in FIG. 4. The aluminum film 52 having a thickness of 1000 Å or more permits an electrical resistance thereof to be reduced to a level of several ohms or less, so that a deterioration in electrostatic shielding characteristics and electron diffusion characteristics of the aluminum film 52 may be effectively prevented.

Also, the aluminum film 52 is arranged on the whole rear surface of the face plate 51, so that the whole face plate 51 may act as a mirror surface. This effectively prevents an architrave-like frame from being observed around the display section, unlike the prior art shown in FIG. 4.

Now, electric resistance of the aluminum film 52 and a heat dissipation function thereof will be considered.

As a result of comparing electric resistance of the aluminum film 52 and that of the chromium film 22 shown in FIG. 4 with each other, aluminum is reduced in resistivity as compared with aluminum. Also, the chromium film 22 must form a half mirror. This requires to form the chromium half mirror into a thickness of 190 Å or less (light transmittance of substantially 0%). On the contrary, the aluminum film 52 has a thickness of 1000 Å or more, resulting in being reduced in electric resistance as compared with the chromium film 22.

Aluminum generally has thermal conductivity several times as large as chromium, so that the aluminum film 52 may exhibit an enhanced heat dissipating function as compared with the chromium film 22 shown in FIG. 4. Also, the aluminum film 52 is applied to the whole rear surface of the face plate 51, to thereby be exposed to an exterior of the fluorescent display device. Thus, the aluminum film 52 exhibits an increased heat dissipating function from a viewpoint of a structure of the fluorescent display device as well, as compared with the chromium film 22.

Figure 2A:
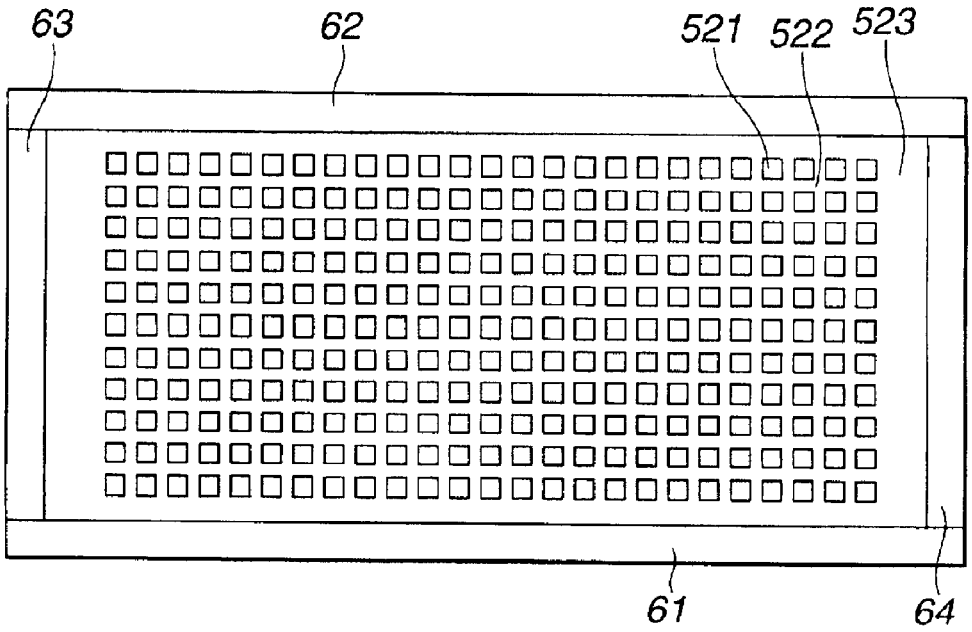
FIG. 2(*a*) is a plan view of the fluorescent display device taken along an arrow Z of FIG. 2(*b*)
Figure 2B:
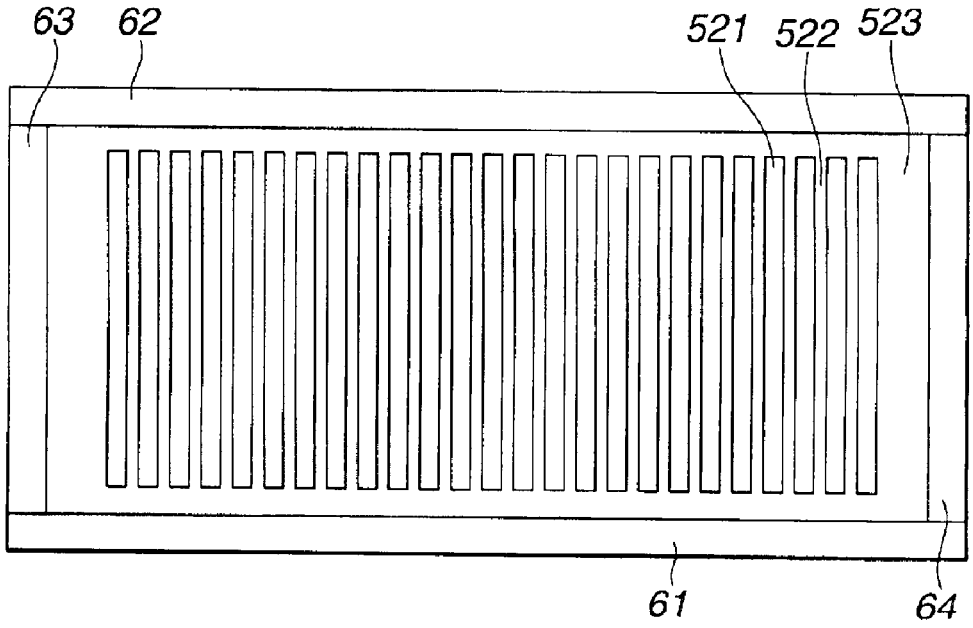

A modification of the aluminum film 52 shown in FIG. 2(*a*) is illustrated in FIG. 2(*b*). The aluminum film 52 shown in FIG. 2(*a*), as described above, is so configured that the opening portions 521 and non-opening portions 522 are arranged in a lattice-like manner. In the modification shown in FIG. 2(*b*), opening portions 521 each are formed into a slit-like configuration. The aluminum film 52 of FIG. 2(*b*) exhibits substantially the same function as that shown in FIG. 2(*a*). The aluminum film 52 of FIG. 2(*b*), when the slit of each of the opening portions 521 is formed into a superfine width, may cause moire fringes. Moire fringes may be utilized for decoration. If they interfere with display, the openings 521 are formed into a predetermined width or more.

Chemical reaction of the sealing glass material 65 such as, for example, lead borosilicate glass may cause a surface of the aluminum film 52 facing the sealing glass material 65 to be blackened in a thickness of about hundreds of angstroms. However, a thickness of the aluminum film 52 increased as compared with that of the chromium film 22 shown in FIG. 4 prevents such blackening from appearing on a side of the face plate 51. Thus, the illustrated embodiment prevents a deterioration in visibility of obtained display due to the blackening.

Figure 3A:
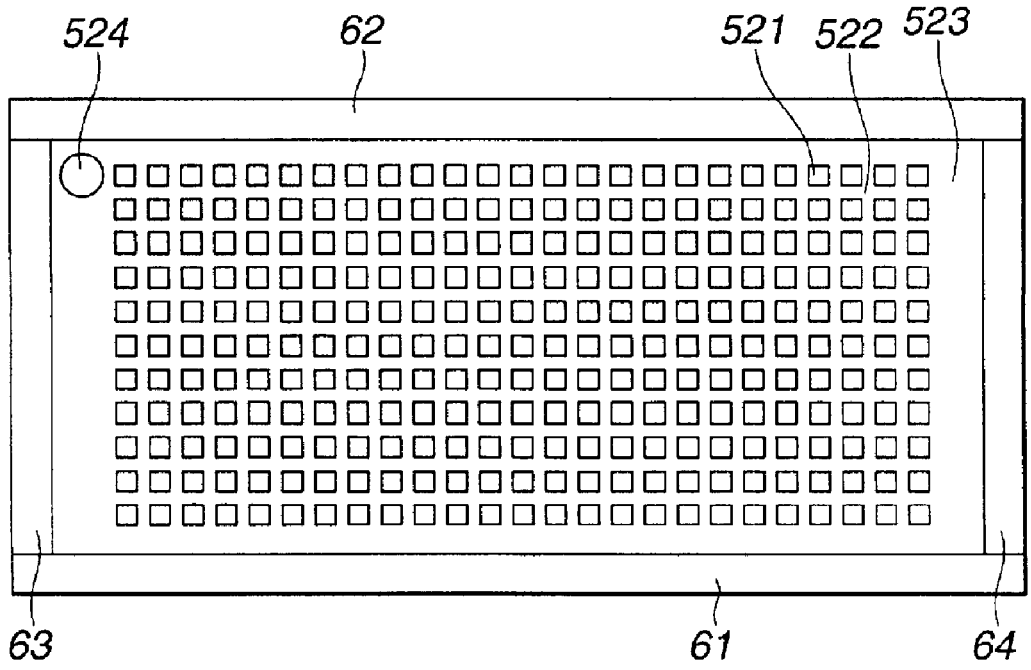
FIG. 3(*a*) is a perspective view showing another embodiment of a fluorescent display device according to the present invention.
Figure 3B:
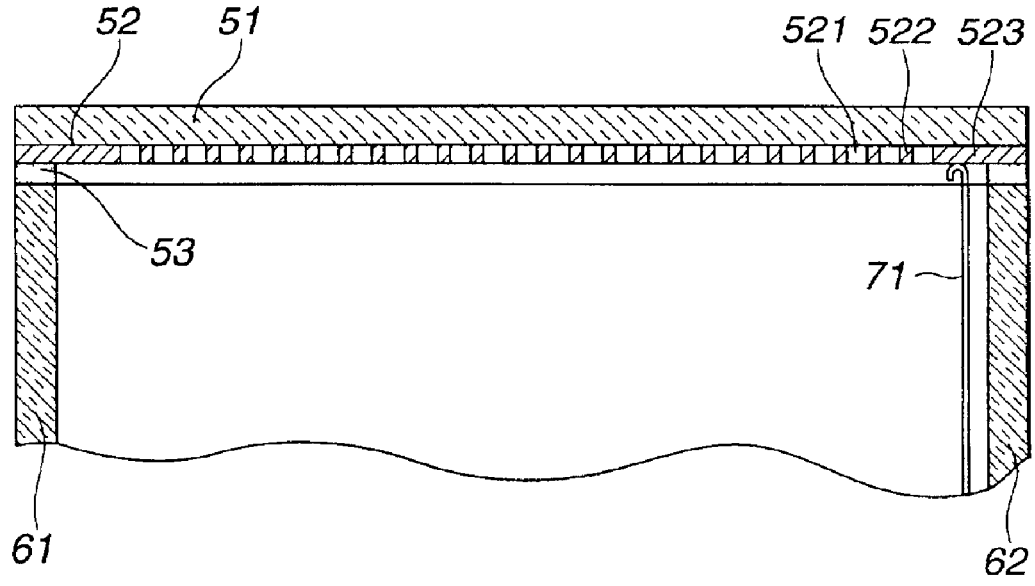

Referring now to each of FIGS. 3(*a*) and 3(*b*), another embodiment of a fluorescent display device according to the present invention is illustrated. FIG. 3(*a*) is substantially the same as FIG. 2(*a*), except a void portion 524. The void portion 524 is kept from formation of an aluminum film thereon. The void portion 524 has a getter material such as barium or the like deposited thereon during evaporation of a getter (not shown). During manufacturing of the fluorescent display device, it is required to confirm whether a getter is evaporated. Covering of a rear surface of a face plate with an aluminum film 52 renders such confirmation hard because an interior of the fluorescent display device is hard to observe. In the illustrated embodiment, the getter is arranged in proximity to the void portion 524, so that the getter material may be deposited on the void portion 524 when the getter is evaporated. This results in the evaporation of the getter being readily confirmed. The getter material forms a mirror surface-like film exhibiting a metallic feeling, like the aluminum film 52. This prevents the void portion 524 from forming an obstruction after completion of the fluorescent display device.

It is not required that void portion 524 is formed into a fully void configuration. It may be formed into any other suitable configuration such as a slit-like shape, a lattice-like shape or the like so long as it has a void which permits the getter material to be deposited thereon.

FIG. 3(*b*) is substantially the same as FIG. 1(*b*) except a contact lead 71. The contact lead 71 is pressedly contacted at one end thereof with a solid portion 523 of the aluminum film 52, to thereby be electrically connected to the aluminum film 52. The solid portion 523 is formed into a thickness substantially larger than the chromium film 22 shown in FIG. 4. Such configuration of the solid portion 523 prevents the solid portion 523 from being damaged by one end or a distal end of the contact lead 71, to thereby prevent a failure in electrical contact between the contact lead 71 and the solid portion 523. The contact lead 71 is connected at the other end thereof to a cathode support or the like to apply a predetermined potential such as a filament potential or the like to the aluminum film 52.

The above-description has been made in connection with the pseudo half mirror made of the aluminum film 52. However, the film material for the pseudo half mirror is not limited to aluminum.

Also, in each of the embodiments described above, the aluminum film 52 is formed on the whole inner surface of the face plate 51. Alternatively, the aluminum film 52 may be arranged on a portion of the face plate 51 corresponding to the display section, to thereby increase contrast of display.

Further, in each of the embodiments, the opening portions 521 are formed on a portion of the aluminum film 52 corresponding to the display section. Alternatively, the opening portions may be formed on the whole aluminum film 52.

Moreover, in each of the above-described embodiments, the opening portions 521 are arranged in a lattice-like manner or formed into a slit-like configuration. However, arrangement of the opening portions and a configuration thereof are not limited to the above. Also, a direction of the lattice or slit may be selected as desired.

As can be seen from the foregoing, the fluorescent display device of the present invention is so constructed that the metal film formed on the rear surface of the face plate and including the opening portions and non-opening portions provides the pseudo half mirror which exhibits a function like a neutral density filter.

Light transmittance of the pseudo half mirror is determined depending on a ratio in area between the opening portions of the metal film and the non-opening portions thereof. This does not require that the non-opening portions have light transmittance of 0% or prevents transmission of light therethrough. This eliminates a necessity of forming the metal film all over the face plate while accurately controlling a thickness thereof, unlike the conventional half mirror. Also, the present invention effectively prevents oxidation of the metal film during calcination in manufacturing of the fluorescent display device from adversely affecting light transmittance of the pseudo half mirror. This permits the metal film for the pseudo half mirror to be formed without considering a thickness of the film and an effect of oxidation thereof in setting of light transmittance of the pseudo half mirror, resulting in formation of the metal film being facilitated.

The present invention is configured so as to permit light transmittance of the pseudo half mirror to be selected as desired only by varying a ratio in area between the opening portions of the metal film and the non-opening portions thereof. Such configuration, when reflectance in the fluorescent display device is varied depending on a position therein, permits light transmittance of the pseudo half mirror to be varied in corresponding to such a variation in reflectance.

The present invention permits aluminum to be used for the metal film for formation of the pseudo half mirror, to thereby eliminate use of harmful and expensive chromium in the prior art. Also, aluminum is used as a material for anode electrodes of the fluorescent display device, wirings provided therein and the like as well, therefore, the pseudo half mirror may be formed in a manner like the anode electrodes, wirings and the like. This not only facilitates manufacturing of the fluorescent display device but leads to a reduction in manufacturing cost thereof because of eliminating a troublesome treatment for chromium since the fluorescent display device contains no chromium. Also, the present invention prevents disposal of the fluorescent display device from causing environmental pollution by chromium.

As described above, the present invention may be so constructed that the metal film for the pseudo half mirror is arranged on the whole rear surface of the face plate including the adhesion area or sealing portion. Such construction positively prevents an architrave-like frame from being observed along the sealing portion, unlike the conventional fluorescent display device, resulting in preventing the display section from being observed in a size smaller than an actual size thereof. Also, the metal film made of aluminum exhibits a metallic feeling, so that the fluorescent display device may exhibit a satisfactory harmony of colors or designs with respect to an equipment of metallic finish on which the fluorescent display device is mounted.

Aluminum is reduced in resistivity as compared with aluminum. Thus, use of aluminum for the metal film for the pseudo half mirror of the present invention permits the metal film to be reduced in electric resistance as compared with the chromium film for the conventional half mirror. Also, the metal film is increased in thickness as compared with the chromium film, leading to a further reduction in electric resistance of the metal film. This permits the metal film for the pseudo half mirror of the present invention to exhibit uniform and sufficient electrostatic shielding and electron diffusion functions over the whole surface thereof.

Aluminum has thermal conductivity larger than chromium, so that the aluminum film for the pseudo half mirror of the present invention may exhibit an enhanced heat dissipating function as compared with the chromium film for the conventional half mirror. Also, when the aluminum film is applied to the whole rear surface of the face plate, it is permitted to be exposed to an exterior of the fluorescent display device, resulting in the heat dissipating function being further enhanced.

The metal film for the pseudo half mirror according to the present invention is light-impermeable and increased in thickness. Thus, even when the metal film is blackened on a surface thereof contacted with the sealing glass material, such blackening does not appear on a side of the face plate, to thereby prevent a deterioration in visibility of display.

Further, in the present invention, the metal film for the pseudo half mirror is formed into an increased thickness sufficient to prevent damage to the metal film due to contact of a distal end of the contact lead with the metal film, resulting in preventing a failure in electrical connection between the contact lead and the metal film.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fluorescent display device comprising:

a vacuum envelope constituted by a face plate, an anode-side substrate and side plates;

cathodes arranged between said face plate and said anode-side substrate; and a metal film for a pseudo half mirror arranged on a rear surface of said face plate and including opening portions and non-opening portions;

wherein said metal film is formed with a void portion for confirming deposition of a getter thereon.

2. A fluorescent display device as defined in claim 1, wherein said metal film is formed on a whole rear surface of said face plate.

3. A fluorescent display device as defined in claim 1, wherein said metal film is made of aluminum having a thickness of 1000 Å or more.

4. A fluorescent display device as defined in claim 2 or 3, wherein said opening portions and non-opening portions are arranged in a lattice-like manner.

5. A fluorescent display device as defined in claim 1, wherein said metal film has at least two regions and includes said opening portions and said non-opening portions formed on each of said regions;

wherein said metal film is partially varied in light transmittance by varying a ratio in area between said opening portions and said non-opening portions in each of said regions.

6. A fluorescent display device as defined in claim 1, wherein said metal film for said pseudo half mirror arranged on a whole rear surface of said face plate including a display section of said fluorescent display device and a sealing section of said face plate and said side plates and including said opening portions and said non-opening portions formed at a portion of said metal film corresponding to said display section of said fluorescent display device.

7. A fluorescent display device as defined in claim 6, wherein said metal film includes a solid portion formed at a peripheral portion of said metal film corresponding to said sealing section of said face plate.

* * * * *